US005210891A

United States Patent [19]

Avital et al.

[11] Patent Number: 5,210,891

[45] Date of Patent: May 18, 1993

[54] PORTABLE MATTRESS AND ACCESSORY KIT

[76] Inventors: Noni Avital; Iko Avital, both of 30 Wingate St., Raanana, Israel

[21] Appl. No.: 642,442

[22] Filed: Jan. 17, 1991

[30] Foreign Application Priority Data

Jan. 22, 1990 [IL] Israel ..... 93116

[51] Int. Cl.[5] ..... A47G 9/06

[52] U.S. Cl. ..... 5/420; 5/419

[58] Field of Search ..... 5/417, 419, 420, 98.1; 224/151, 156; 190/1

[56] References Cited

U.S. PATENT DOCUMENTS

| | | | |
|---|---|---|---|
| 748,288 | 12/1903 | Klein | 5/413 |
| 954,840 | 4/1910 | Wiedemann | 5/417 |
| 2,552,443 | 5/1951 | Molinari | 224/151 |
| 2,902,195 | 9/1959 | Marshall | 224/151 |
| 3,268,922 | 8/1966 | Moxley | 5/420 |
| 3,419,309 | 12/1968 | Smith | 5/98.1 |
| 3,537,116 | 11/1970 | Kain | 5/420 |
| 4,154,323 | 5/1979 | Sneider | 5/417 |
| 4,273,274 | 6/1981 | Freistadt | 224/151 |
| 4,375,111 | 3/1983 | Hall | 5/420 |
| 4,489,815 | 12/1984 | Martinez et al. | 5/417 |
| 4,500,129 | 2/1985 | Hahn | 5/420 |
| 4,546,507 | 10/1985 | Weinstein | 5/419 |
| 4,601,076 | 7/1986 | Knobeloch | 5/413 |
| 4,654,907 | 4/1987 | Haugaard | 5/420 |
| 4,671,393 | 6/1987 | Rainey | 190/1 |
| 4,738,545 | 4/1988 | Westgor | 5/420 |
| 4,794,029 | 12/1988 | Tennant et al. | 190/1 |
| 4,863,003 | 9/1989 | Carter | 5/420 |
| 4,868,940 | 9/1989 | Masadi | 5/420 |
| 4,938,607 | 7/1990 | Kelley | 190/1 |
| 4,967,428 | 11/1990 | Browder | 5/420 |
| 4,984,906 | 1/1991 | Little | 5/420 |
| 4,991,245 | 2/1991 | Franco | 5/417 |
| 5,002,401 | 3/1991 | Blackman | 190/1 |
| 5,010,610 | 4/1991 | Ackley | 5/420 |

FOREIGN PATENT DOCUMENTS

| | | | |
|---|---|---|---|
| 761135 | 1/1934 | France | 5/419 |
| 2561506 | 9/1985 | France . | |
| 513610 | 10/1971 | Switzerland . | |

OTHER PUBLICATIONS

Campmor (catalog), p. 31, Mid Summer 1985.

"Playmat/Play-Yard" (brochure), Apr. 1987.

*Primary Examiner*—Renee S. Luebke

*Assistant Examiner*—Michael J. Milano

*Attorney, Agent, or Firm*—Edward Langer

[57] ABSTRACT

A portable foam mattress and accessory kit designed to afford comfortable sleep or rest in many applications and to allow for storage of related personal items. In the preferred embodiment, the portable foam mattress and accessory kit answers the need for comfort and portability in a novel design integrating the use of a thick foam pad within textile materials provided as a flexible cover made of cloth or synthetic fabric, conveniently shaped as a portable shoulder carrying bag. The flexible cover is formed with pockets for storage of personal items or accessories, such as clothing or articles of personal hygiene. When unfolded, the foam mattress can be laid on a floor, providing a truly comfortable resting surface, by use of an appropriately thick foam mattress. The foam pad is foldable into the travel shape with the flexible covering material forming its own carrying bag with straps, reducing bulkiness since no separate carrying bag is needed. The straps serve a dual function by maintaining the kit in the folded travel shape and providing a convenient means of carrying it.

15 Claims, 10 Drawing Sheets

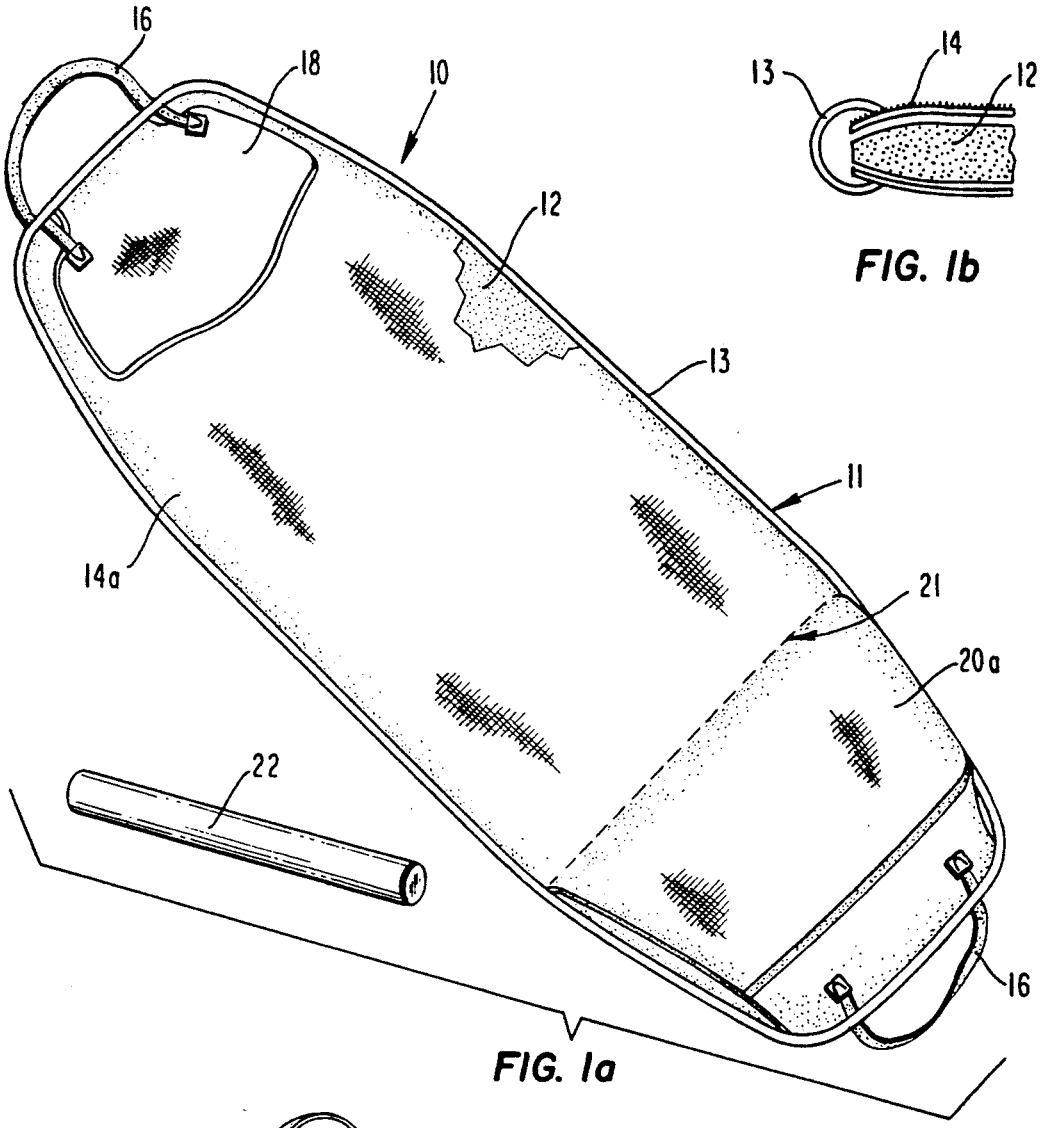
FIG. 1a
FIG. 1b
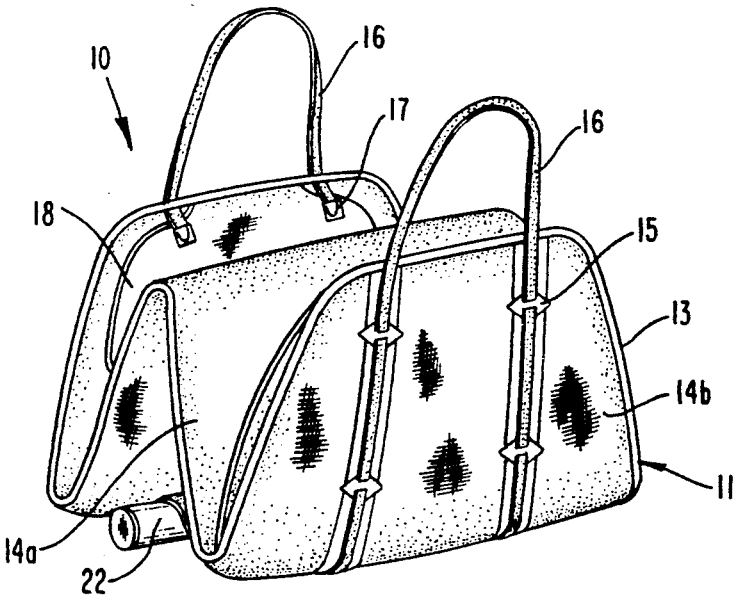
FIG. 1c

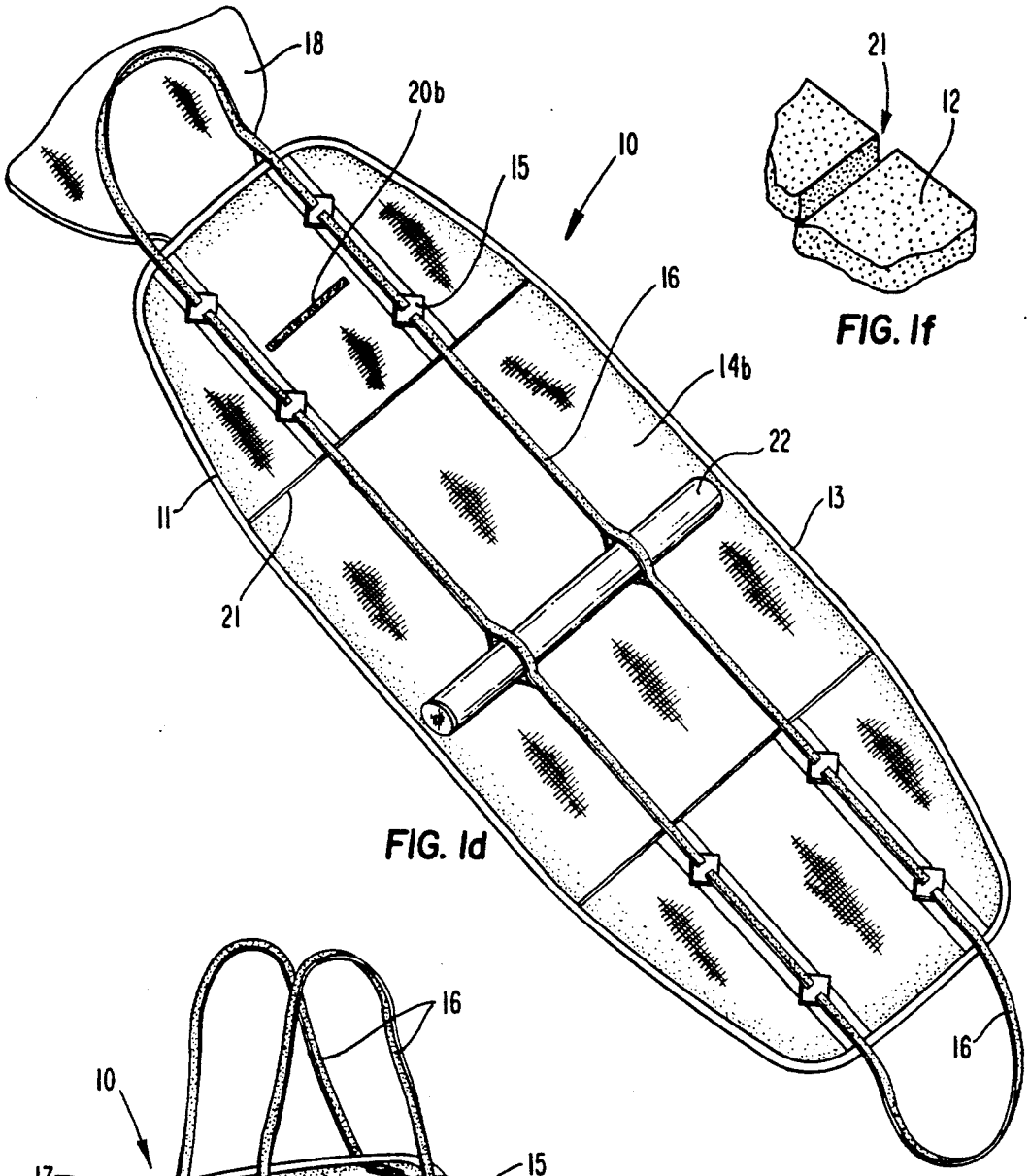
FIG. 1d
FIG. 1f
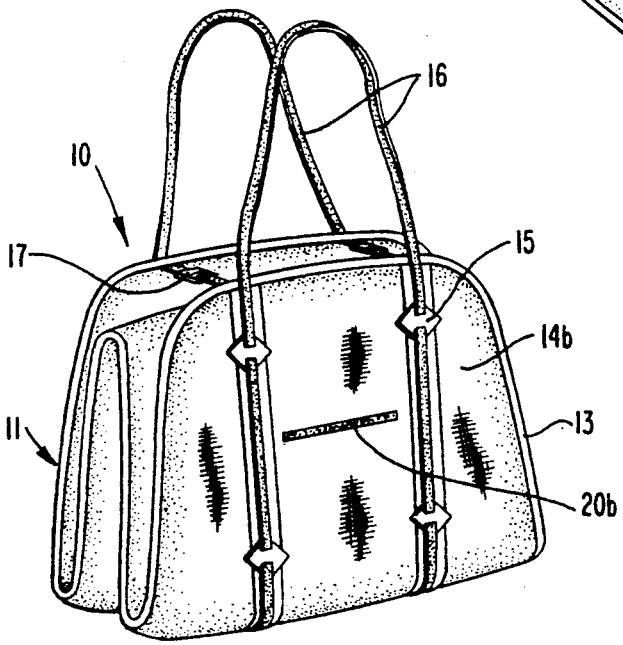
FIG. 1e

PORTABLE MATTRESS AND ACCESSORY KIT

FIELD OF THE INVENTION

The present invention relates to portable equipment and accessories for bedding, lounge and beach applications, and more particularly, to a novel portable foam mattress kit designed for carrying various personal accessories associated with sleeping, resting and sunbathing applications while at home, traveling, or at the beach.

BACKGROUND OF THE INVENTION

The prior art of bedding equipment includes storable sleeping apparatus such as that described in U.S. Pat. No. 4,601,076 to Knobeloch, which is a rectangularly-shaped bag-like container enclosing a foam pad, with a cover sheet attached at one container end, the apparatus being foldable into a roll. While this design allows for storage, it is not designed for portability and it does not provide storage for personal items which a user typically carries when traveling, such as clothing, a toothbrush, etc.

A portable changing caddy for a baby having a basket and a foam pad folded around the basket is disclosed in U.S. Pat. No. 4,792,024 to Morton et al. This size of the folded pad in this design is not suitable for sleeping or resting as it is related to the size of the basket contour, which is relatively small.

A convertible mat and carrying bag combination for sunbathing is disclosed in U.S. Pat. No. 4,375,111 to Hall. In this design, a thin foam mat is foldable into a size for storage in a carrying bag, which has a carrying strap. Because this is a two-piece arrangement, the possibility exists that the mat and bag will become separated during use, and one of them may be lost. In addition, the thin foam mat does not provide a comfortable resting surface.

As with many accessories related to sleeping or resting while traveling, there is a need to simplify the equipment available with regard to bulkiness. In the designs described above, the provision of a thin foam pad reduces bulkiness, but at the expense of comfort. Use of a thick foam pad, however, creates particular manufacturing difficulties since upholstery stitching is required to enclose such a pad in a covering fabric, and this requires special machinery.

In addition, the need to periodically clean portable equipment after use is not easily accomplished with existing foam pad designs, since water which enters through the covering materials does not easily evaporate. Furthermore, existing equipment does not satisfactorily address the need for storage of personal items, including accessories for beach use such as a sun umbrella.

The need to provide temporary arrangements for sleeping and resting occurs in many situations, including those involving guest accomodations, or when children stay overnight at the home of a friend. Outdoor camping activities also require sleeping equipment. When traveling or visiting while caring for an infant, there is always the need for temporary sleeping or resting equipment. At the beach, portable and comfortable lounging equipment is always needed. In short, a coordinated solution is needed to address the problems of portability, comfort and storage of related personal accessories, in many applications.

Therefore, it would be desirable to provide washable portable sleeping/lounging apparatus which allows for comfortable rest and provides for convenient and compact storage of personal accessories.

SUMMARY OF THE INVENTION

Accordingly, it is a principal object of the present invention to overcome the above-mentioned disadvantages of the prior art and provide a portable foam mattress and accessory kit which is designed to incorporate the features necessary to afford comfortable sleep or rest in many applications and to allow for storage of related personal items.

In accordance with a preferred embodiment of the invention, there is provided portable foam mattress and accessory kit apparatus comprising a foam pad-like member capable of assuming a first travel shape and a second substantially planar shape, said pad-like member being contained within a flexible covering material substantially enclosing it therein, at least one storage means being attached to said covering material for storage of personal items, said covering material having attached thereto a strap for carrying said member when assuming said travel shape, said pad-like member comfortably supporting a user in a reclined position when assuming said planar shape.

In the preferred embodiment, the portable foam mattress and accessory kit answers the need for comfort and portability in a novel design integrating the use of a thick foam pad within textile materials provided as a flexible cover made of cloth or synthetic fabric, conveniently shaped as a portable shoulder carrying bag. The flexible cover is formed with pockets for storage of personal items or accessories, such as clothing or articles of personal hygiene. When unfolded, the foam mattress can be laid on a floor, providing a truly comfortable resting surface, by use of an appropriately thick foam mattress.

Unlike prior art designs which use a very thin foam pad, the inventive foam pad mattress and accessory kit allows for use of a foam pad having increased thickness. This is because the foam pad is foldable into the travel shape with the flexible covering material forming its own carrying bag with straps, reducing bulkiness since no separate carrying bag is needed. The straps serve a dual function by maintaining the kit in the folded travel shape and providing a convenient means of carrying it.

The thick foam pad is disposed between layers of the covering material by an edge strip which is stitched from the outside, to simplify manufacturing and assembly procedures.

The inventive mattress and accessory kit is suited for many products and applications, such as a portable, folding baby mattress kit including side flaps forming an enclosed play area for outdoor/indoor use. Another application is a portable foam mattress sleeping bag arranged as a backpack with pockets for storage of personal items, which is particularly useful for children's overnight slumber parties.

Yet another application of the inventive design is a beach mat and accessory kit having a cylindrically shaped container attached by straps at one end of a rolled up foam mattress. The container is adapted to open once the mattress has been rolled out, and provides a storage compartment for several beach accessories, including tanning lotions, sunglasses, etc. The container can also be used as a cushion for supporting the head.

A feature of the invention is the provision of the flexible covering material as a type that allows "breathing" so that the entire article including the foam pad material can be washed in an automatic washer, and dried in an ordinary manner.

By virtue of its unique design, the inventive foam pad mattress and accessory kit serves a variety of needs associated with sleeping or resting while meeting the requirements of portability, comfort and convenient storage of personal articles.

Other features and advantages of the invention will become apparent from the drawings and the description contained hereinbelow.

BRIEF DESCRIPTION OF THE DRAWINGS

For a better understanding of the invention with regard to the embodiments thereof, reference is made to the accompanying drawings, in which like numerals designate corresponding elements or sections throughout, and in which:

FIGS. 1-*f* illustrate a portable foam mattress and accessory kit apparatus foldable into the shape of a carrying bag, as designed and constructed in accordance with the principles of the present invention;

DETAILED DESCRIPTION OF THE PREFERRED EMBODIMENTS

Figure 2A:
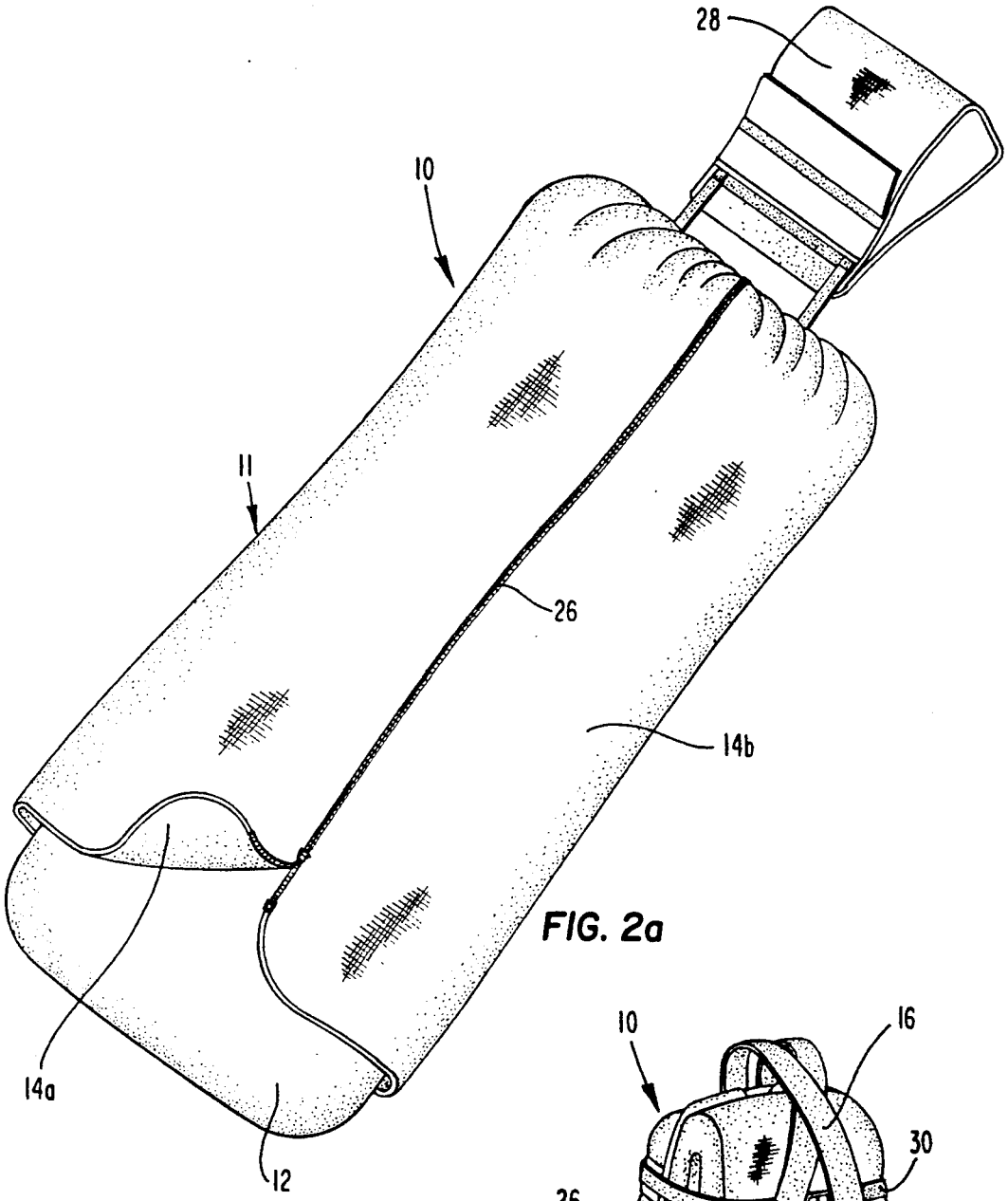
FIGS. 2*a–d* illustrate the inventive kit apparatus configured as a sleeping bag foldable into a backpack.

Referring now to FIGS. 1*a–e*, there are illustrated perspective views of a portable foam mattress and accessory kit apparatus 10 designed and constructed in accordance with the principles of the present invention. Apparatus 10 comprises a single sheet foam mattress 12 enclosed within a bag 11 formed of flexible covering material 14*a–b*. Material 14*a* is used on the side of mattress 12 with which the user comes into contact, and is typically a woven polyester and cotton fabric, providing a smooth finish. Material 14*b* is used on the outer side of mattress 12, and is typically a durable synthetic fabric. As shown in FIG. 1*b*, the method of outer stitching is used to fasten an edge strip 13 of covering material 14 along the perimeter of mattress 12, thus enabling the use of a "sandwich" design of covering materials 14*a–b* and mattress 12, which simplifies manufacturing procedures.

As shown in FIG. 1*c*, mattress 12 may be folded into the shape of a travel bag 11 which is highly portable, complete with a convenient carrying strap 16 which slides within strap guides 15 which are attached to covering material 14*b*. Strap 16 provides a dual function, both maintaining the kit apparatus 10 in the folded travel shape by use of buckles 17, and providing a convenient means of carrying it. FIG. 1*d* shows the carrying strap 16 provided as a loop having an overall length just slightly greater than mattress 12 length when it is unfolded. As shown in FIG. 1*e*, when mattress 12 is folded, the excess carrying strap 16 loop length is available for carrying as a shoulder bag 11.

Mattress 12 is typically fabricated of polyurethane, polyester or other synthetic foam material of a suitable thickness to provide a genuinely comfortable rest surface when opened and laid out flat on a floor or the ground, as shown in FIG. 1*a*. An approximate thickness of 10–50 mm, depending on the density of the foam chosen, provides suitable firmness while allowing easy folding of mattress 12.

As best shown in FIG. 1*d*, carrying strap 16 is attached to one side of covering material 14, and a flap 18 folds over one end of mattress 12 when the latter is folded in the travel shape. Flap 18 is preferably made of foam and is also enclosed in covering material 14 and is stitched to mattress 12 at one end. Inner and outer zippered storage pockets 20*a* and 20*b* (FIGS. 1*a* and 1*e*) are provided in covering material 14 for carrying personal accessories. As shown in FIG. 1*a*, flap 18 unfolds and may also be used as a pillow cushion for the head when mattress 12 is unfolded for use.

As shown in the inset of FIG. 1*d*, in order to facilitate folding, a joint 21 is formed by "scoring" one side of foam mattress 12 and forming a crevice therein at points along its length, thereby reducing the thickness of mattress 12 which is folded at these points. This simplifies the user's task in folding mattress 12, when lifting it from the position shown, as joints 21 tend to "automatically" fold into the travel shape.

Also illustrated in FIGS. 1*a* and 1*c–d* is a hollow tube 22, which is provided to fit under carrying strap 16 and hold a sun umbrella, which is useful when sunbathing on mattress 12. Other applications for the kit apparatus 10 embodiment of FIGS. 1*a–e* include resting or sleeping at home or while traveling.

In accordance with the inventive design, flexible covering material 14 is a fabric laminate which allows "breathing" so that the entire article including the foam mattress 12 can be washed in an automatic washer, and dried in an ordinary manner. This feature simplifies cleaning procedures and extends the useful life of the article provided by kit apparatus 10. The laminate is provided by a thin layer of PVC or similar material which is used to coat the inner surface of covering material 14*a–b*, so that the fabric is only semi-permeable to water.

Figure 2B:
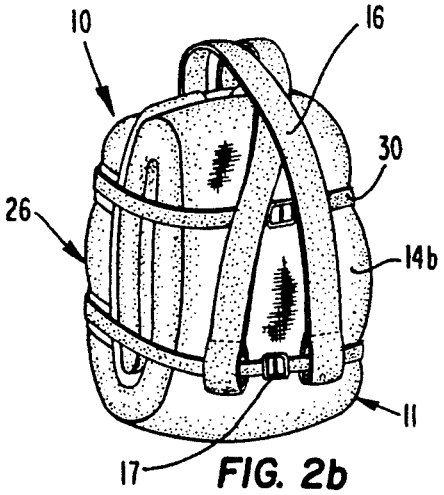
Figure 2C:
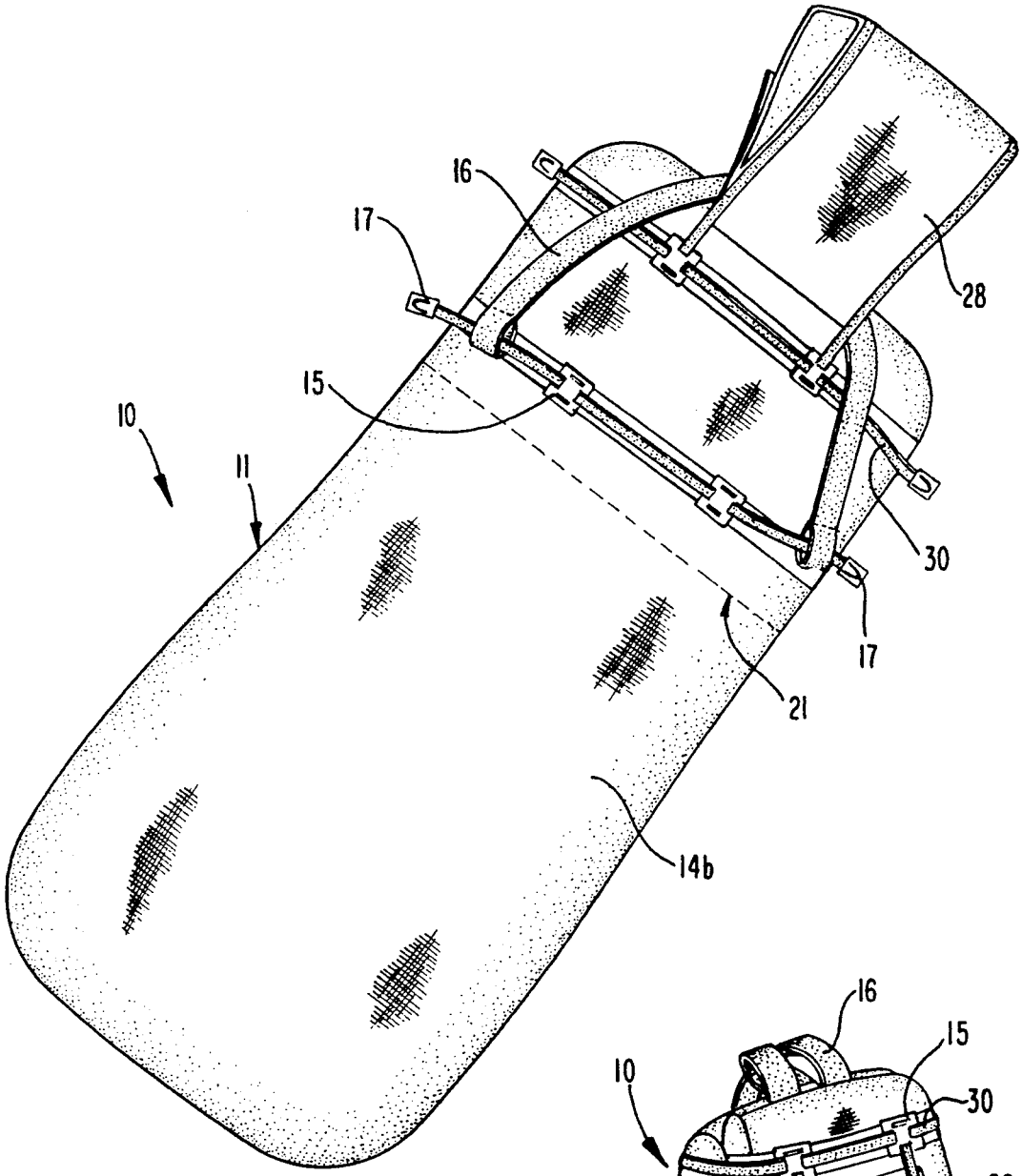
Figure 2D:
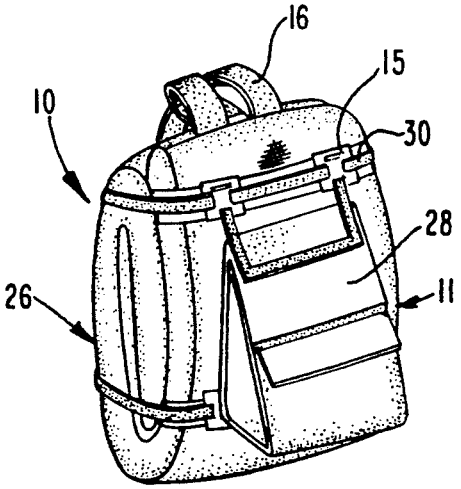

Referring to FIGS. 2*a–d*, foam mattress and accessory kit apparatus 10 is shown configured as a sleeping bag 11. FIGS. 2*a* and 2*c* are, respectively, front and rear views of sleeping bag 11 in the open shape, and FIGS. 2*b* and 2*d* are respectively, front and rear perspective views of sleeping bag 11 in a backpack travel shape. This shape is especially useful for children, who can carry it with their clothing and personal items when staying overnight at a friend's home. The portable sleeping facility and storage means combination serves all temporary needs.

In the arrangement of FIGS. 2*a–d*, foam mattress 12 is removably insertable within sleeping bag 11 which has a zipper 26 around its perimeter. At one end of sleeping bag 11, a pouch 28 similar to flap 18 (FIG. 1) is provided for carrying personal accessories. Pouch 28 is attached to strap guides 15 (FIG. 2*c*) which are themselves attached to covering material 14. Carrying strap 16 is attached to a set of retaining straps 30 and arranged as a shoulder harness for the backpack travel shape. As with flap 18, pouch 28 does not become separated from mattress 12 once unfolded, although it may be placed alongside sleeping bag 11.

Figure 3A:
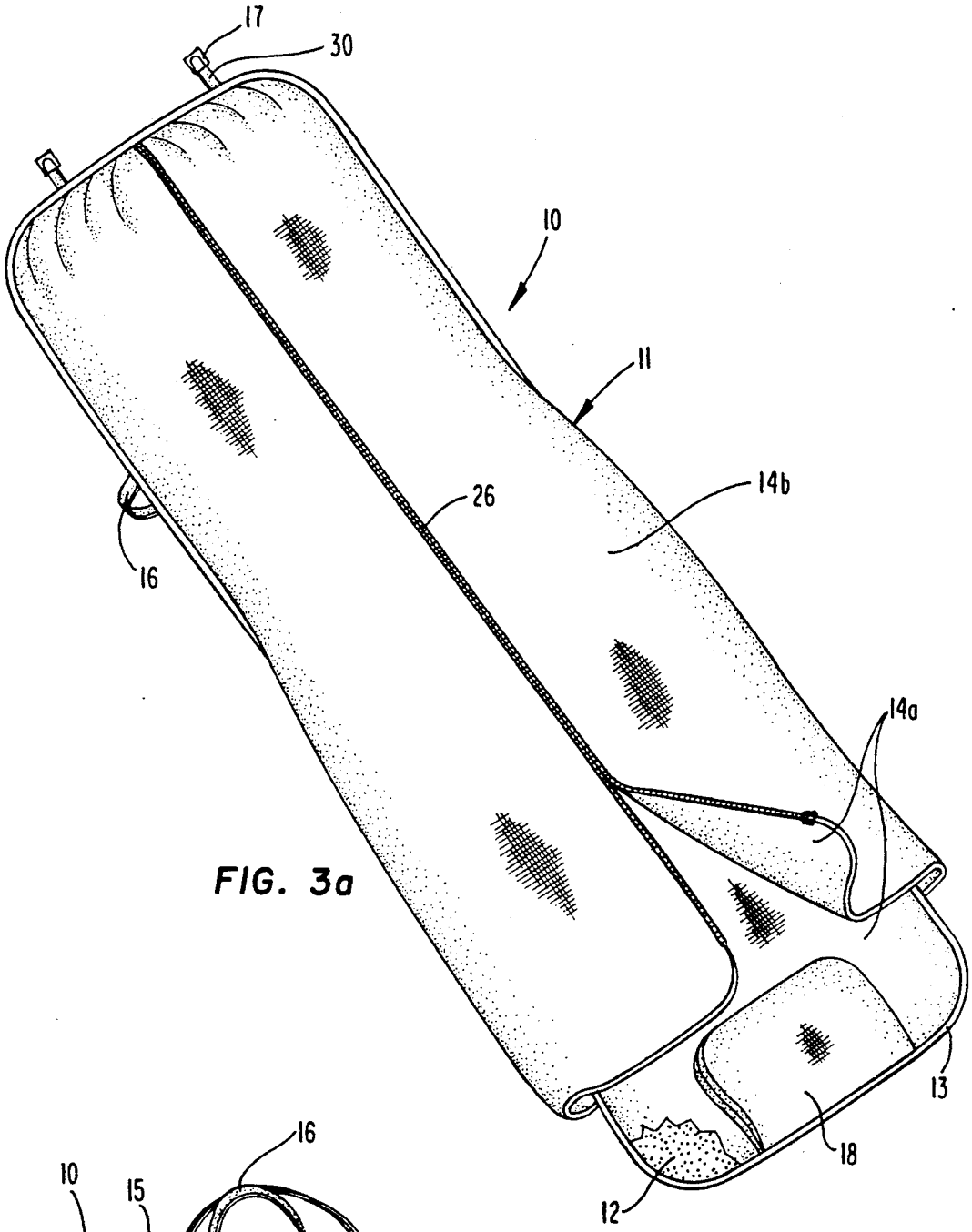
FIGS. 3*a–d* illustrate an alternative embodiment of the sleeping bag configuration of the kit apparatus of FIGS. 2*a–d;*
Figure 3B:
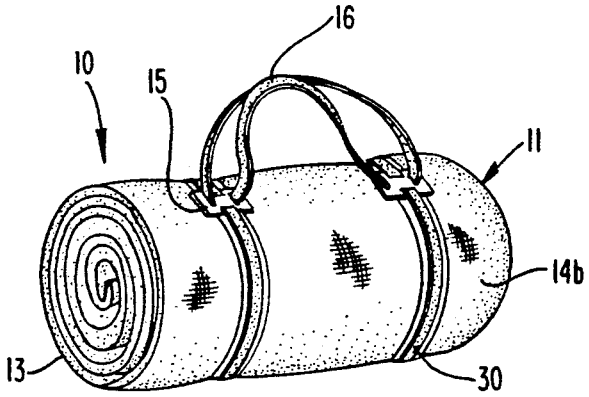
Figure 3C:
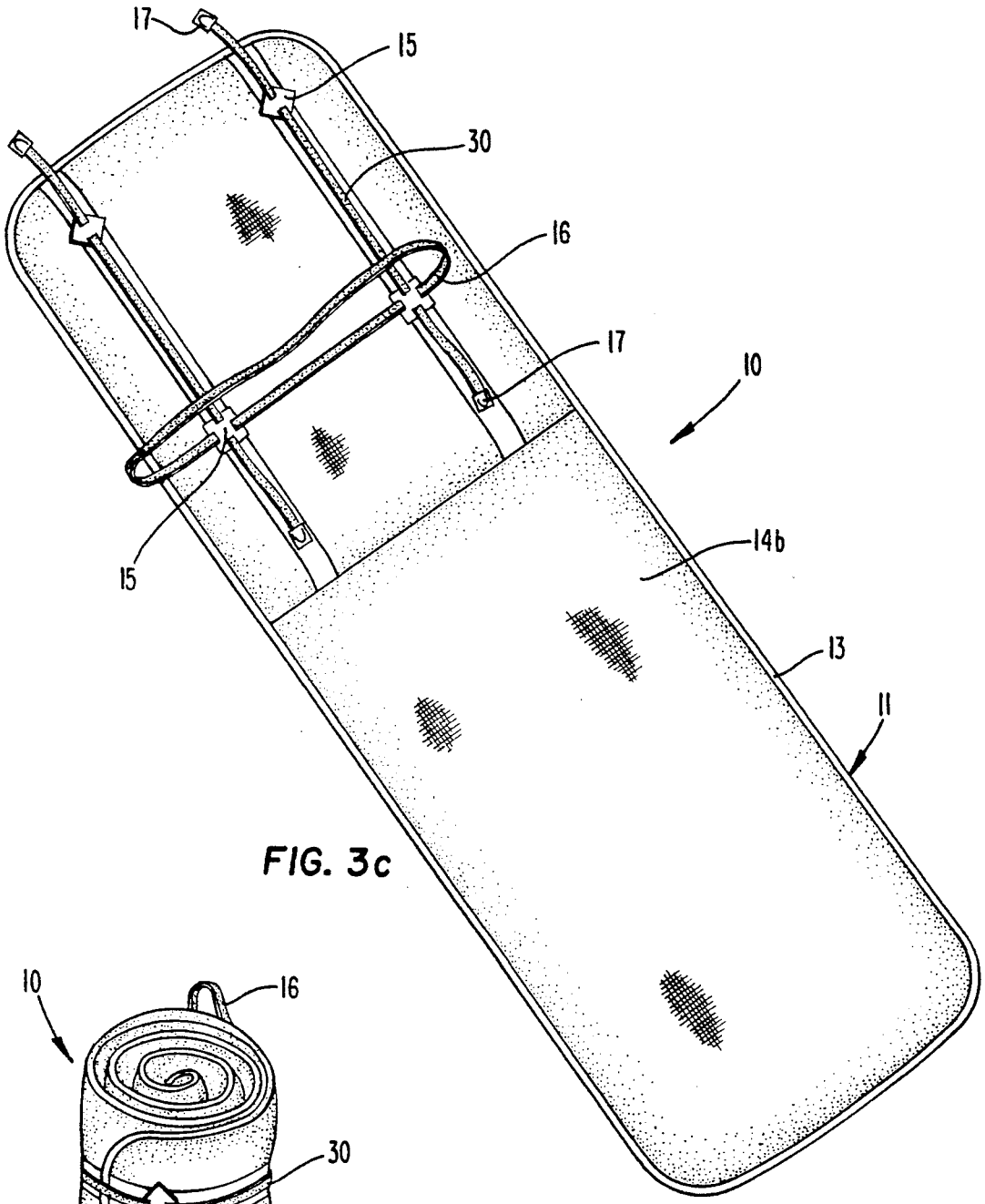
Figure 3D:
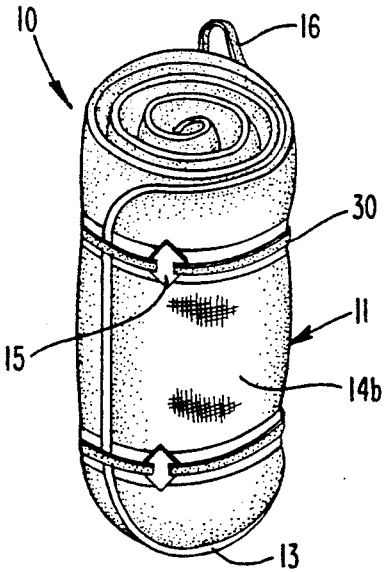

FIGS. 3*a–d* show an alternative embodiment of the sleeping bag configuration of FIGS. 2*a–d*. FIGS. 3*a* and 3*c* show, respectively, front and rear views of sleeping bag 11, and FIGS. 3*b* and 3*d* show sleeping bag 11 rolled up into a convenient travel shape. In this arrangement, covering material 14 is attached on one side of bag 11 to foam mattress 12 so that the latter is not removable. When rolled into the travel shape, sleeping bag 11 may be wrapped by a set of retaining straps 30, to which carrying strap 16 is attached at strap guides 15. Carrying strap 16 slides within strap guides 15 which are attached to covering material 14 to enable portability. As shown in FIG. 3*d*, a flap 18 may be provided as a pillow, as in the embodiment of FIG. 1. Although not illustrated in FIG. 3*a*, flap 18 may be provided with a pocket for personal accessories.

Figure 4A:
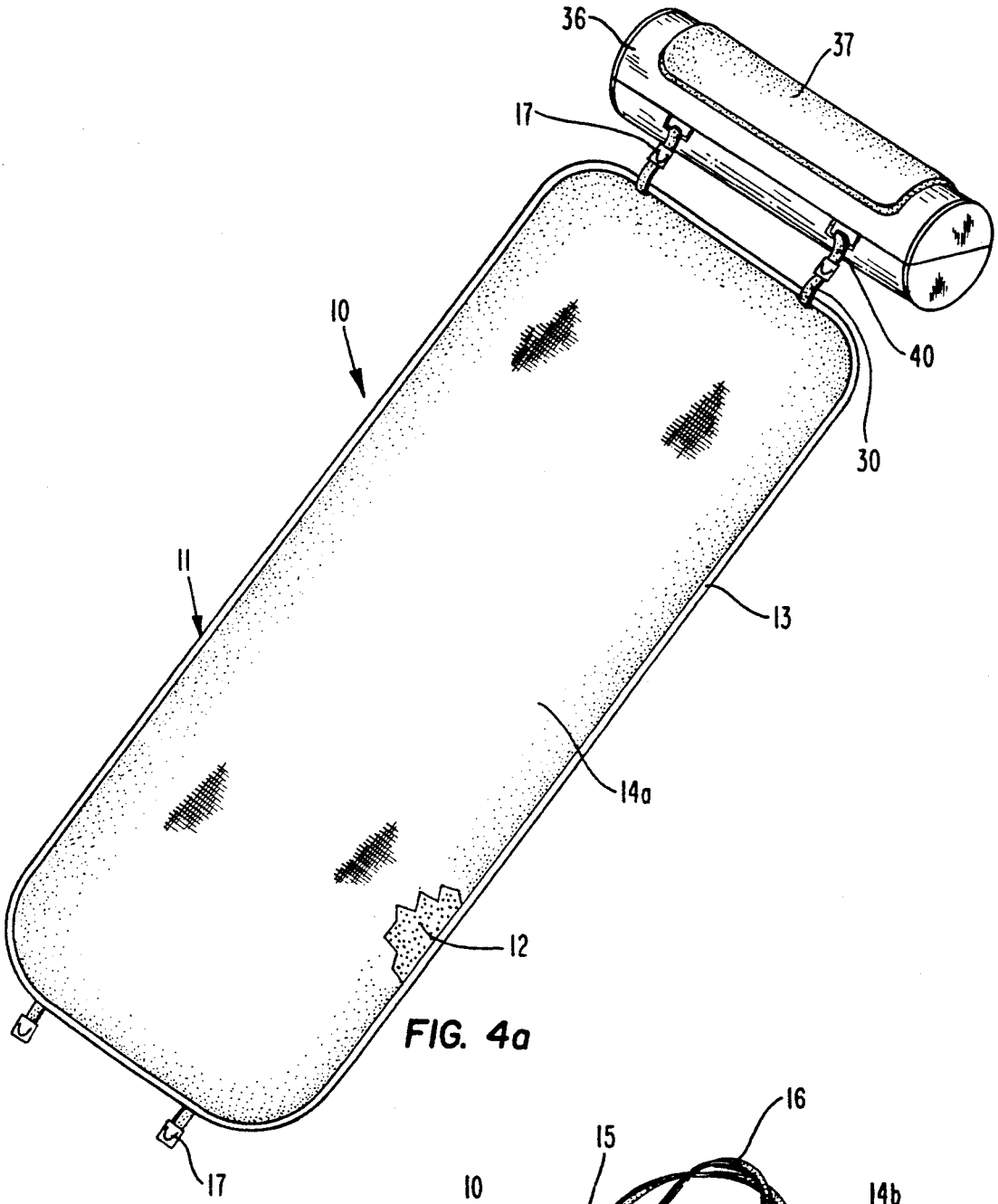
FIGS. 4*a–d* illustrate the inventive kit apparatus configured as a beach mat.
Figure 4B:
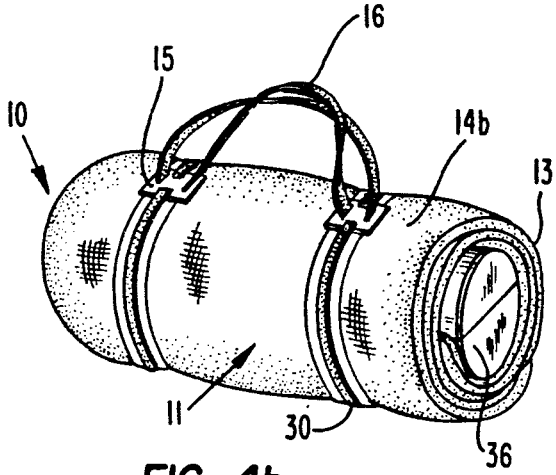
Figure 4C:
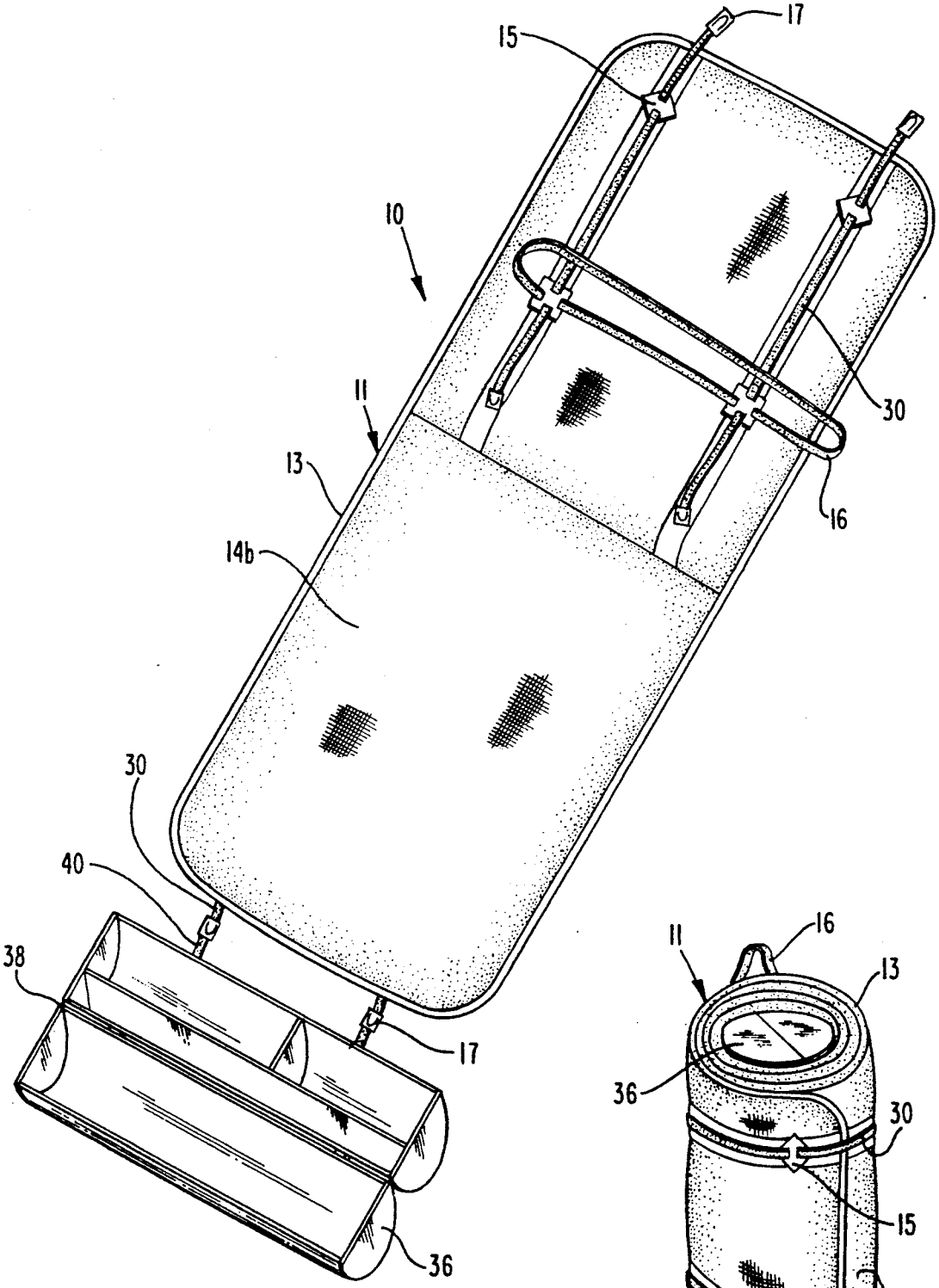
Figure 4D:
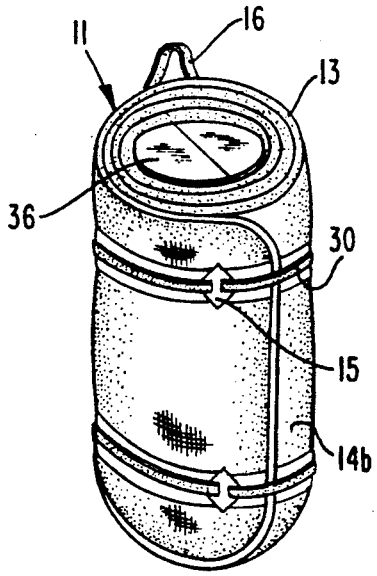

In FIGS. 4*a–d*, foam mattress and accessory kit apparatus 10 is shown configured as a beach mat. The foam mattress 12 thickness provides a comfortable rest and can be coiled and held by retaining straps 30 and buckles 17 in a travel shape as shown in FIG. 4*b*, about a centrally disposed cylindrical container 36. Mattress bag 11 can be unrolled for use as in FIG. 4*a*, and container 36 can be opened on hinges 38 as shown in FIG. 4*c* for placement or removal of personal accessories stored therein. Connecting straps 40 are tied to the free ends of retaining straps 30 via buckles 17 and connect container 36 to bag 11 so that they do not become separated in use. Container 36 may also serve as a support for the head, and it may have a padded portion 37 on its outer surface for this purpose.

By virtue of its design from a fabric laminate only semi-permeable to water, when the user lies on the beach mat after swimming, no appreciable amount of water passes through covering material 14 and foam mattress 12 remains relatively dry.

It will be appreciated that although the embodiments of FIGS. 1–4 indicate a design useful for an individual user, the overall size of foam mattress 12, etc. may be increased to allow for use by two persons, with additional folds being provided as necessary to reduce bulkiness and maintain portability.

Figure 5A:
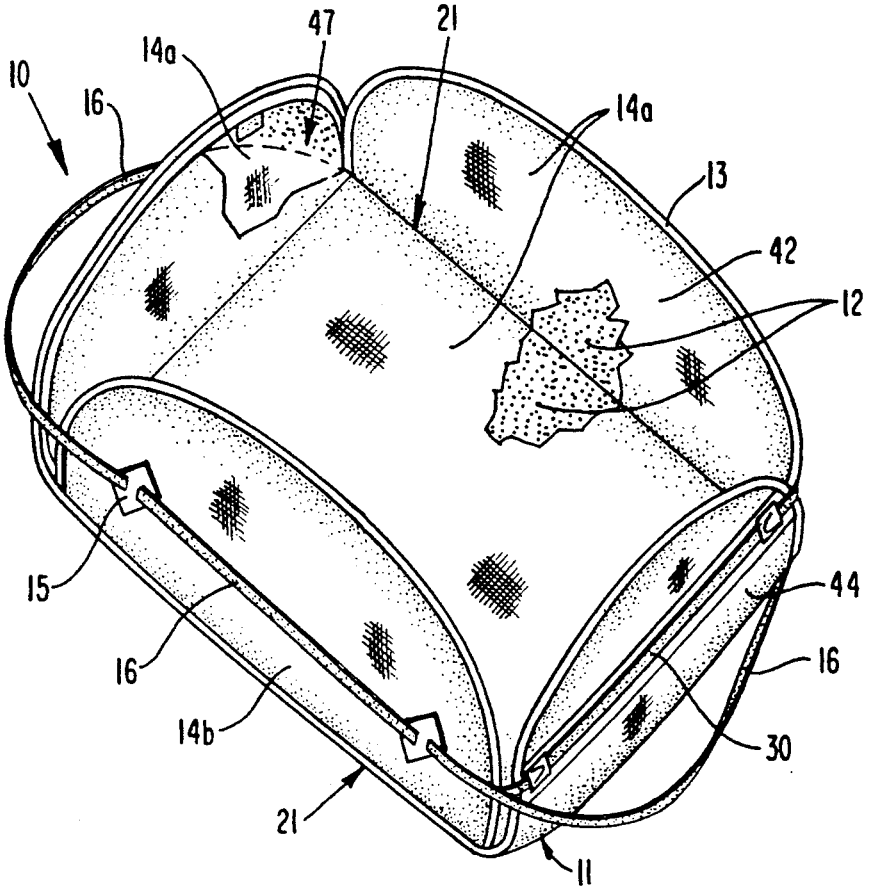
FIGS. 5*a–d* illustrate the inventive kit apparatus configured as a baby play and sleeping mat.
Figure 5B:
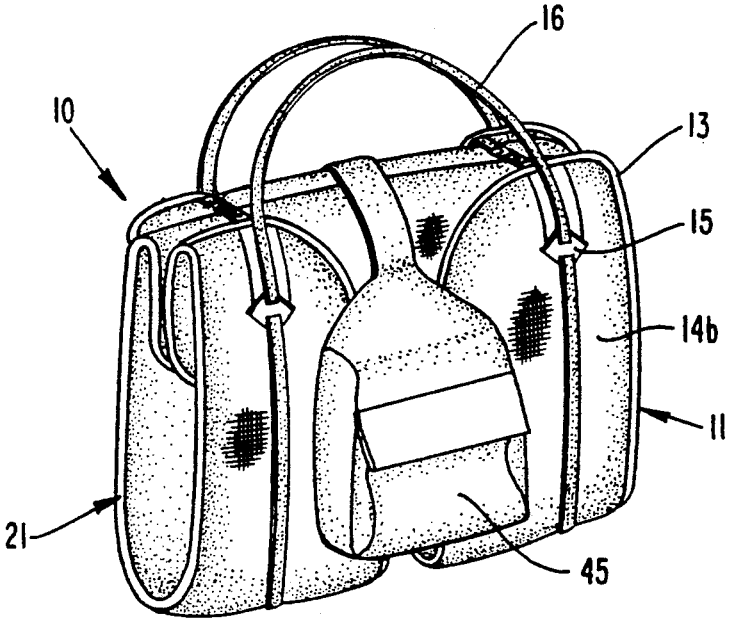
Figure 5C:
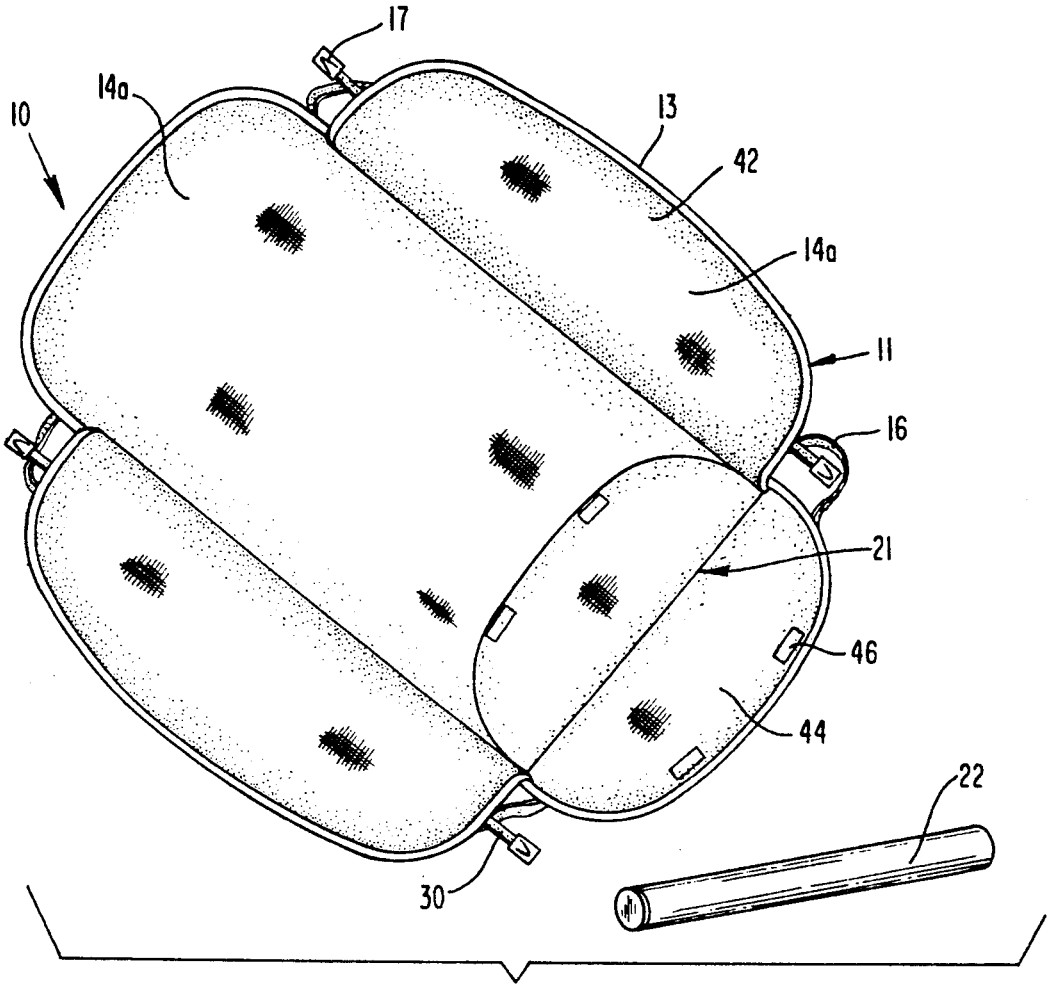
Figure 5D:
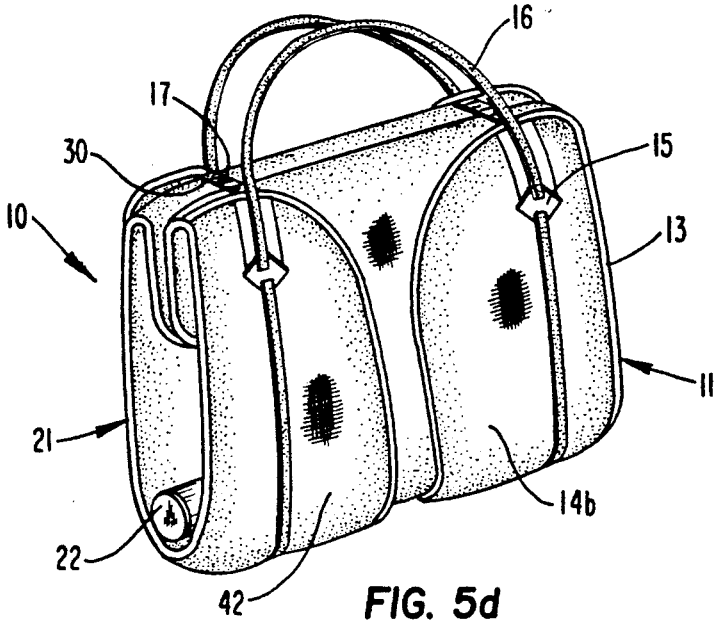

Referring now to FIGS. 5*a–d*, foam mattress and accessory kit 10 is shown configured as a baby play and sleeping mat. FIGS. 5*a* and 5*c* are, respectively, top perspective views of the baby play mat, with flexible side and end panels 42 and 44 in raised and lowered positions. FIGS. 5*b* and 5*d* are, respectively, front and rear views of the baby play and sleeping mat kit apparatus 10 folded in the travel shape as a carrying bag 11. As shown in FIGS. 5*c* and 5*d*, a sun umbrella may be stored in hollow tube 22 retained within the folded travel shape. FIG. 5*d* shows an accessory storage pouch 45 designed to overlay the folded travel shape.

Side and end panels 42 and 44 fold at the junction with mattress 12, and are themselves foldable. The covering material 14 on end panel 44 is provided in two layers which can be separated and reattached such as by use of a tab 46 (FIG. 5*c*) made of Velcro material, to provide a pocket 47 for convenient storage of baby accessories, lotions, etc. Retaining straps 30 attached to side and end panels 42 and 44 are used to maintain them in the raised position during use, and to retain kit 10 in the travel shape once folded. When side and end panels 42 and 44 are raised (FIG. 5*a*), the perimeter of kit 10 provides an enclosed area for a baby to sit up or nap comfortably on foam mattress 12.

The baby play and sleeping mat provides a readily available solution to various needs of infant care. In addition to providing a working area for changing of diapers, it provides a comfortable and safe enclosed area for movement and resting, and effectively replaces play pens and other bulky equipment.

In summary, by virtue of its unique design, the inventive foam pad mattress and accessory kit apparatus serves a variety of needs associated with sleeping or resting while traveling, while creatively meeting requirements related to portability, comfort and convenient storage of personal articles.

Having described the invention with regards to certain specific embodiments, it is to be understood that the description is not meant as a limitation since further modifications may now suggest themselves to those skilled in the art and it is intended to cover such modifications as fall within the scope of the appended claims.

We claim:

1. A portable foam mattress and accessory kit apparatus comprising a foam pad-like member capable of assuming a first travel shape and a second substantially planar shape, wherein the length of said member defined between the ends thereof varies between maximum and minimum dimensions when said member assumes a respective one of said planar and travel shapes, said pad-like member being contained within a flexible covering material substantially enclosed it therein, at least one storage means being attached to said covering material for storage of personal items, said covering material having attached thereto a strap for carrying said member when assuming said travel shape and retaining it therein, said carrying strap being provided as a continuous loop attached to said covering material by a set of guides through which it passes in sliding fashion, the overall length of said carrying strap loop being slightly greater than said maximum member length, such that when said member assumes said travel shape by folding on each of a plurality of axes transverse to its length, said carrying strap slides in relation thereto and provides an excess carrying strap loop length enabling said member to be carried as a shoulder bag, said pad-like member comfortably supporting a user in a reclined position when assuming said planar shape.

2. The apparatus of claim 1 wherein said flexible covering material is provided as a washable fabric coated on at least one side thereof with a layer of material making it semi-permeable to water.

3. The apparatus of claim 1 wherein the overall thickness of said member is relatively large and is enclosed by an edge strip being attached to the edges of said flexible covering material by an outer stitch.

4. The apparatus of claim 1 wherein a surface of said member is scored with a line forming a crevice therein which has a reduced thickness defining a folding point of said member.

5. The apparatus of claim 1 further comprising side and end panels disposed about the perimeter of said member at joints formed of said flexible covering material, said side and end panels being movable at said joints into upright and flat orientations while said member assumes said planar shape, said carrying strap providing support for said side and end panels in said upright orientation so as to define an open-top box shape, said flat orientation enabling said member and said side and end panels to be folded.

6. The apparatus of claim 1 wherein said storage means comprises a pocket provided within said covering material.

7. The apparatus of claim 1 wherein said storage means comprises a pouch attached to said carrying strap.

8. The apparatus of claim 1 wherein said storage means comprises a cylindrical container attached to said covering material at an end of said member, said travel shape being assumed by rolling said member about said container.

9. The apparatus of claim 1 wherein said pad-like foam member is fabricated of one of polyurethane, polyester and synthetic foam materials having an approximate thickness of between 10 and 50 mm.

10. The apparatus of claim 1 configured as a portable sleeping mat.

11. The apparatus of claim 1 configured as a sleeping bag.

12. The apparatus of claim 1 configured as a beach mat.

13. The apparatus of claim 1 configured as a baby play and sleeping mat.

14. The apparatus of claim 1 wherein said travel shape is assumed by rolling said member into a coil.

15. The apparatus of claim 1 further comprising a sun umbrella contained within a tube adapted for carrying in a folded portion of said member in said travel shape.

* * * * *